US010413030B1

(12) United States Patent
Douglas et al.

(10) Patent No.: US 10,413,030 B1
(45) Date of Patent: Sep. 17, 2019

(54) CONTAINER INSERT AND CONTAINER ASSEMBLY

(71) Applicant: Quintessential Tots, LLC, Naperville, IL (US)

(72) Inventors: Kelly M. Douglas, Naperville, IL (US); Brian A. Douglas, Naperville, IL (US)

(73) Assignee: Quintessential Tots, LLC, Naperville, IL (US)

( * ) Notice: Subject to any disclaimer, the term of this patent is extended or adjusted under 35 U.S.C. 154(b) by 0 days.

(21) Appl. No.: 15/382,324

(22) Filed: Dec. 16, 2016

(51) Int. Cl.

| | |
|---|---|
| ***A45C 3/06*** | (2006.01) |
| ***A45C 13/02*** | (2006.01) |
| ***A45C 13/26*** | (2006.01) |
| ***A45C 3/00*** | (2006.01) |
| ***A45C 13/10*** | (2006.01) |

(52) U.S. Cl.
CPC ..... *A45C 13/02* (2013.01); *A45C 3/001* (2013.01); *A45C 3/06* (2013.01); *A45C 13/103* (2013.01); *A45C 13/26* (2013.01); *A45C 2013/026* (2013.01)

(58) Field of Classification Search
CPC .. A45C 13/30; A45C 3/06; A45C 3/08; A45C 13/08
USPC ..... 383/2, 15, 37, 38, 111, 10; 150/107, 150/111, 113
See application file for complete search history.

(56) References Cited

U.S. PATENT DOCUMENTS

| | | | | | |
|---|---|---|---|---|---|
| D161,980 | S * | 2/1951 | Weinstein | 383/15 | |
| 2,721,596 | A * | 10/1955 | Herta | A45C 7/0063 | 150/106 |
| 5,282,686 | A * | 2/1994 | Haber | B65D 33/1608 | 383/10 |
| 5,671,861 | A * | 9/1997 | Hall | B65F 1/06 | 220/495.08 |
| 8,192,083 | B2 * | 6/2012 | Bautista | B65D 33/001 | 383/11 |
| 8,540,106 | B2 * | 9/2013 | Banus | B65D 25/16 | 220/495.08 |
| 2007/0183691 | A1 * | 8/2007 | Finnegan | B65D 33/06 | 383/23 |
| 2007/0209742 | A1 * | 9/2007 | Morgan | A45C 3/08 | 150/105 |
| 2009/0324140 | A1 * | 12/2009 | Fa | B65D 33/08 | 383/10 |

* cited by examiner

*Primary Examiner* — Sue A Weaver
(74) *Attorney, Agent, or Firm* — Greenberg Traurig, LLP

(57) ABSTRACT

A container insert and a container assembly are provided. The container insert includes a main insert portion sized to be inserted into a container. The main insert portion includes an internal volume. The container insert further includes at least one insert handle extending from the main insert portion.

17 Claims, 10 Drawing Sheets

CONTAINER INSERT AND CONTAINER ASSEMBLY

TECHNICAL FIELD OF THE DISCLOSED EMBODIMENTS

The presently disclosed embodiments generally relate to containers and, more particularly, to an insert for a container and container assemblies.

BACKGROUND OF THE DISCLOSED EMBODIMENTS

Containers, such as handbags, diaper bags, or tote bags, may include one or more handles to improve handling and transport of the container and its contents. The container may be made from one or more materials that are flexible or rigid or absorbent or non-absorbent. However, the particular features or limitations may not suit a particular item that a user wishes to carry in the container. For example, if a user wishes to carry a wet or soiled item in a tote bag or other container, the container will become soiled or wet due to the wet or soiled item being placed in the container. In a similar example, if a user wishes to carry one or more fragile or sensitive items in a container through an environment that may adversely affect the items, the container may not adequately protect the items from the environment or condition of the container itself.

Therefore, there exists a need for a container insert and a container assembly having a container insert whereby the container insert may be positioned at least partially in the container to allow particular items to be contained in the container without adversely affecting the container and/or the items in the container insert.

SUMMARY OF THE DISCLOSED EMBODIMENTS

In accordance with an aspect of the present disclosure, a container insert is provided. The container insert includes a main insert portion sized to be inserted into a container, the main insert portion having an internal volume, and at least one insert handle extending from the main insert portion, the at least one insert handle having an insert handle opening sized to accommodate a container handle loop width when the container is held by the container handle.

The at least one insert handle may include a first insert handle extending from a first side of the main insert portion and having a first insert handle opening sized to accommodate a first container handle loop width, and a second insert handle extending from a second side of the main insert portion and having a second insert handle opening sized to accommodate a second container handle loop width. The at least one insert handle may extend above the main insert portion such that the main insert portion is suspended below the at least one insert handle. The at least one insert handle may include a first thickness at a first location and a second thickness at a second location, the first thickness being greater than the second thickness to allow the at least one insert handle to bend at an upper edge of the container. The main insert portion may be substantially waterproof. The main insert portion may include a closure member to substantially seal the internal volume. The insert handle opening of the at least one insert handle may have a first insert handle opening end configured to be substantially aligned with a first container handle end of the container handle and a second insert handle opening end may be configured to be substantially aligned with a second container handle end of the container handle.

In accordance with an aspect of the present disclosure, a container insert is provided. The container insert includes a main insert portion sized to be inserted into a container having at least one upper edge, the main insert portion having an internal volume, and at least one insert handle extending from the main insert portion, the at least one insert handle having a first thickness at a first location and a second thickness at a second location, the first thickness being greater than the second thickness to allow the at least one insert handle to bend at the second location around the at least one upper edge of the container.

The at least one insert handle may include an insert handle opening, the first location may be substantially aligned with the insert handle opening to allow the at least one insert handle to bend at the insert handle opening. The at least one insert handle may include a third thickness at a third location, the second location being disposed between the first location and the third location. The first thickness may be substantially equal to the third thickness. The at least one insert handle may extend above the main insert portion such that the main insert portion is suspended below the at least one insert handle. The at least one insert handle may include a first insert handle extending from a first side of the main insert portion and having a first insert handle opening sized to accommodate a first container handle loop width; and a second insert handle extending from a second side of the main insert portion and having a second insert handle opening sized to accommodate a second container handle loop width. At least one of the first insert handle opening and the second insert handle opening may have a first insert handle opening end configured to be substantially aligned with a first container handle end of a container handle and a second insert handle opening end configured to be substantially aligned with a second container handle end of the container handle. The main insert portion may be substantially waterproof. The main insert portion may include a closure member to substantially seal the internal volume.

In accordance with an aspect of the present disclosure, a container assembly is provided. The container assembly includes a container having a main container portion with a container internal volume, at least one container handle extending from the main container portion and forming a container handle loop having a container handle loop width, a container insert disposed at least partially within the container internal volume and having a main insert portion with an insert internal volume, and at least one insert handle extending from the main insert portion and having an insert handle opening width that is substantially equal to the container handle loop width.

The container insert may include at least one external insert dimension that is substantially equal to an internal container dimension of the container. The at least one insert handle may include a first insert handle extending from a first side of the main insert portion and having a first insert handle opening sized to accommodate a first container handle loop width, and a second insert handle extending from a second side of the main insert portion and having a second insert handle opening sized to accommodate a second container handle loop width. The container may include at least one upper edge, the at least one insert handle may include a first thickness at a first location and a second thickness at a second location, and the first thickness may be greater than the second thickness such that the at least one insert handle may be bent at the second location around the upper edge of the container.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE ENCLOSED EMBODIMENTS

Figure 1:
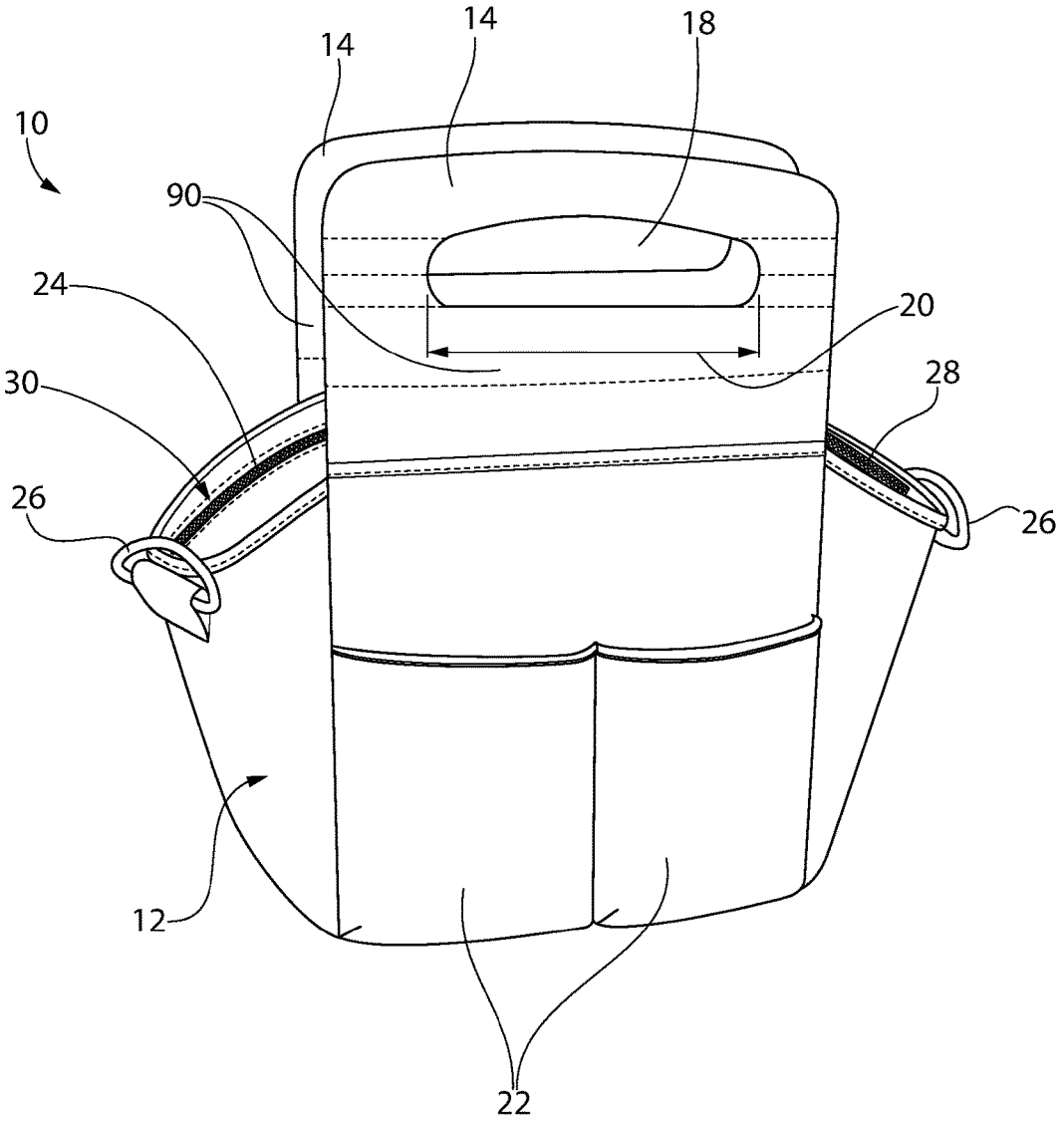
FIG. 1 is a perspective view of a container insert according to one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 5:
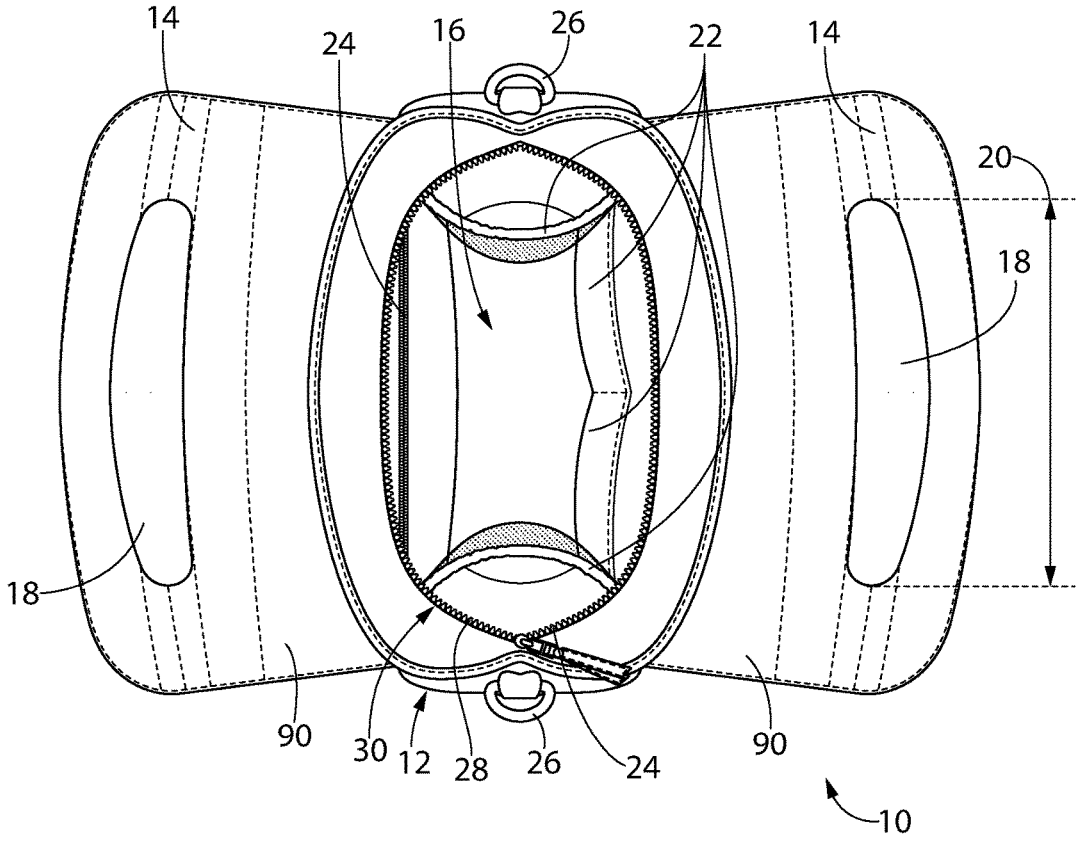
FIG. 5 is a top plan view of a container insert according to one embodiment of the present disclosure.
Figure 6:
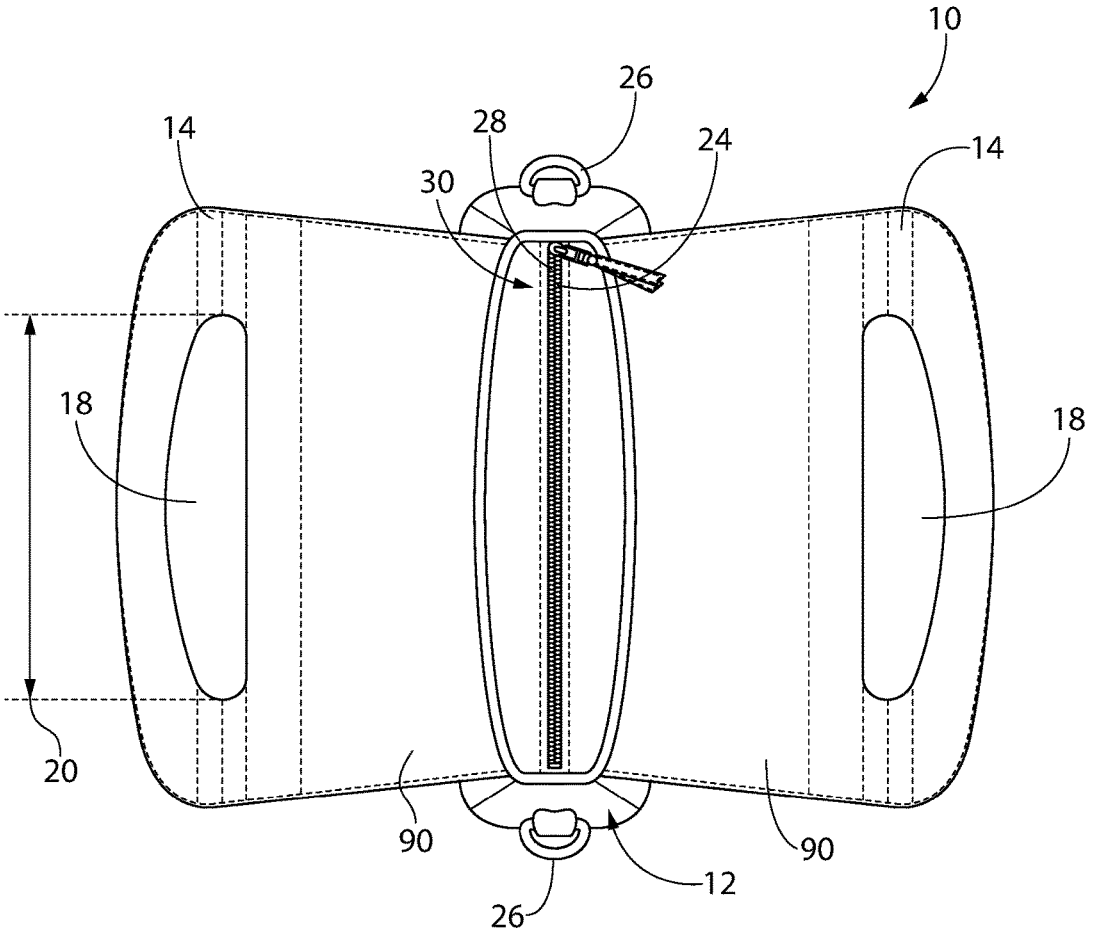
FIG. 6 is a top plan view of a container insert according to one embodiment of the present disclosure.

Referring now to the drawings, FIGS. 1-6 illustrate a container insert 10 in accordance with one or more embodiments of the present disclosure. The container insert 10 includes a main insert portion 12. The main insert portion 12 and/or another portion of the insert 10 includes one or more pockets 22, one or more rings or loops 26, and/or one or more closure members 24, such as a zipper in one non-limiting example, on the inner and outer surfaces of the insert 10 and/or the main insert portion 12. As best illustrated in FIG. 5, the main insert portion 12 includes an internal volume 16. The internal volume 16 is configured to hold or carry one or more items and may include one or more pockets 22, one or more rings or loops 26, and/or one or more closure members 24. The insert 10 and/or the main insert portion 12 further includes a closure member 28 at an upper insert portion 30. The closure member 28 is a zipper in one non-limiting example. The closure member 28 substantially seals the internal volume 16 in one embodiment of the disclosure. In an embodiment, another closure member (not shown) is disposed inside the insert 10 and/or within the internal volume 16 and substantially seals an inner space within the internal volume 16 from the remainder of the internal volume 16. In an embodiment, the insert 10 is waterproof, water-resistant, or otherwise resists moisture absorption and/or passage of moisture through one or more portions of the insert 10 and/or the main insert portion 12 to reduce or prevent moisture or liquids from passing to or from the internal volume 16.

The container insert 10 further includes one or more insert handles 14 in accordance with an embodiment. Each insert handle 14 extends above the main insert portion 12 such that the main insert portion 12 is suspended below the insert handle 14. Each insert handle 14 includes an insert handle opening 18. In an embodiment, one or more insert handles 14 includes a solid or continuous panel 90 between the insert handle opening 18 and the main insert portion 12. The insert handle opening 18 has an insert handle opening width 20. In the embodiment illustrated in FIG. 3, a first insert handle 14 extends from a first side 34 of the main insert portion 12 and includes a first insert handle opening 18 sized to accommodate a first container handle loop width 72, illustrated in FIGS. 7-9 and explained in further detail below, and a second insert handle 14 extends from a second side 40 of the main insert portion 12 and includes a second insert handle opening 18 sized to accommodate a second container handle loop width 72, also explained in further detail below.

The container insert 10 of one or more embodiments not illustrated includes removable or adjustable members, such as snaps in one non-limiting example, at, on, and/or along one or both of the insert handles 14 in order to shorten and/or lengthen the insert handle(s) 14 and improve fitment of the container insert 10 inside of a container 62, explained in further detail below. Similarly, the container insert 10 of one or more embodiments not illustrated includes removable or adjustable members, such as snaps in one non-limiting example, at, in, and/or coupled to any portion of the container insert 10, such as the main insert portion 12, in order to increase and/or decrease the internal volume 16 and/or an overall size of the main insert portion 12 and/or the container insert 10 and improve fitment of the container insert 10 inside of the container 62. In a further embodiment not illustrated, one or both of the insert handles 14 includes one or more ties. The one or more ties of the insert handle(s) 14 may offer removal of the container insert 10 from the container 62, may provide a decorative feature for the container 62, and/or may allow attachment of one or more additional objects or containers to the container insert 10 and/or the container 62.

Figure 10:
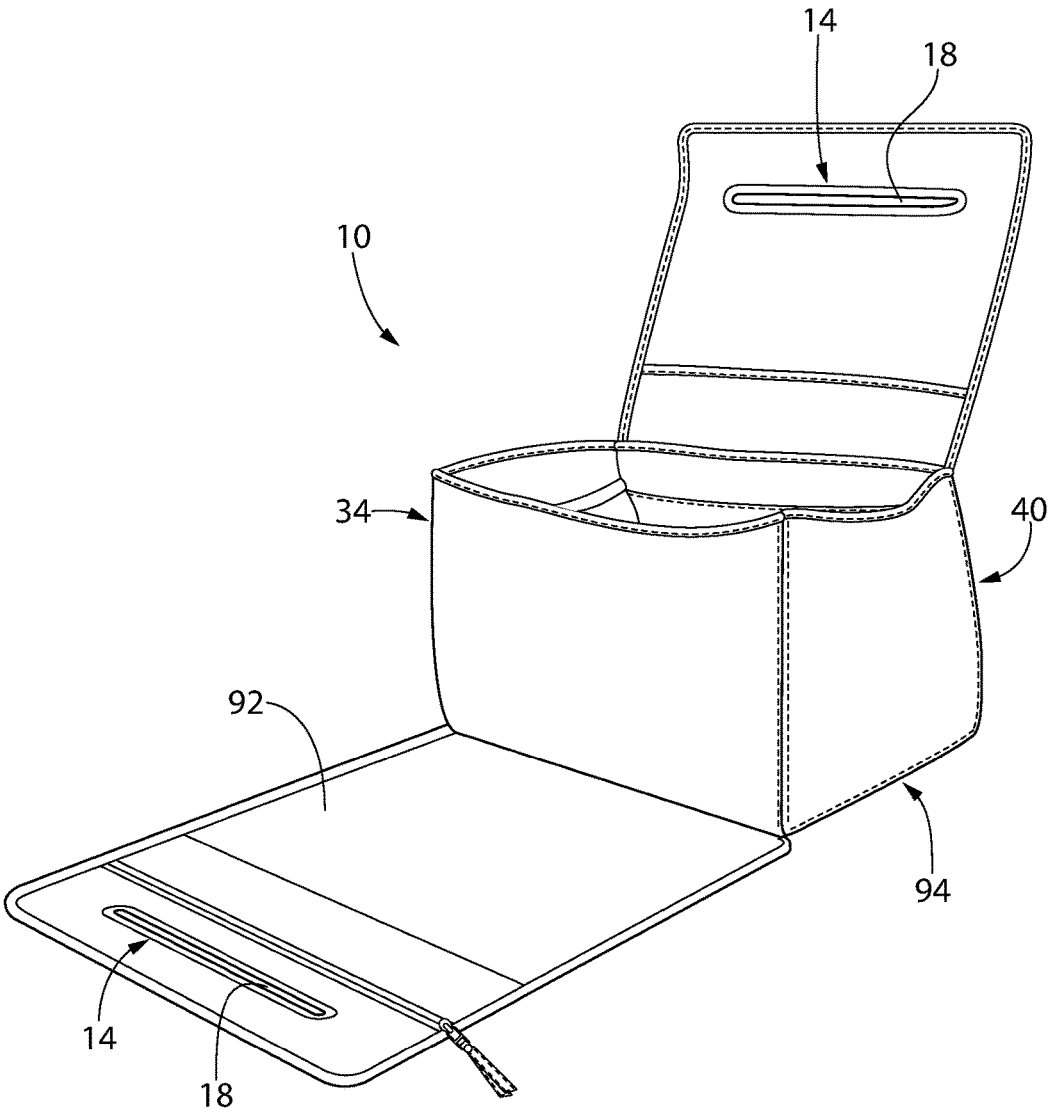
FIG. 10 is a perspective view of a container insert according to one embodiment of the present disclosure.

As illustrated in FIG. 10, an embodiment of the container insert 10 includes a side panel 92 on one or both of the first side 34 and the second side 40. In the embodiment illustrated, the side panel 92 exists only on the first side 34. In additional embodiments not illustrated, the side panel 92 exists on both the first side 34 and the second side 40. The side panel 92 is sized and/or configured to extend from the first or second insert handle 14 to a bottom panel 94 of the main insert portion 12. The side panel 92 provides a surface and/or a covering, such as a changing pad in one non-limiting example, to enhance usage of the container insert 10 and any of its contents. The side panel 92 may be oriented vertically such that the container insert 10 may be used as described in any embodiment(s) described herein. The container insert 10 of FIG. 10 includes first and second insert handle openings 18 that are configured as slits or cuts. The insert handle openings 18 of FIG. 10 may be incorporated into any other embodiment described herein.

Figure 7:
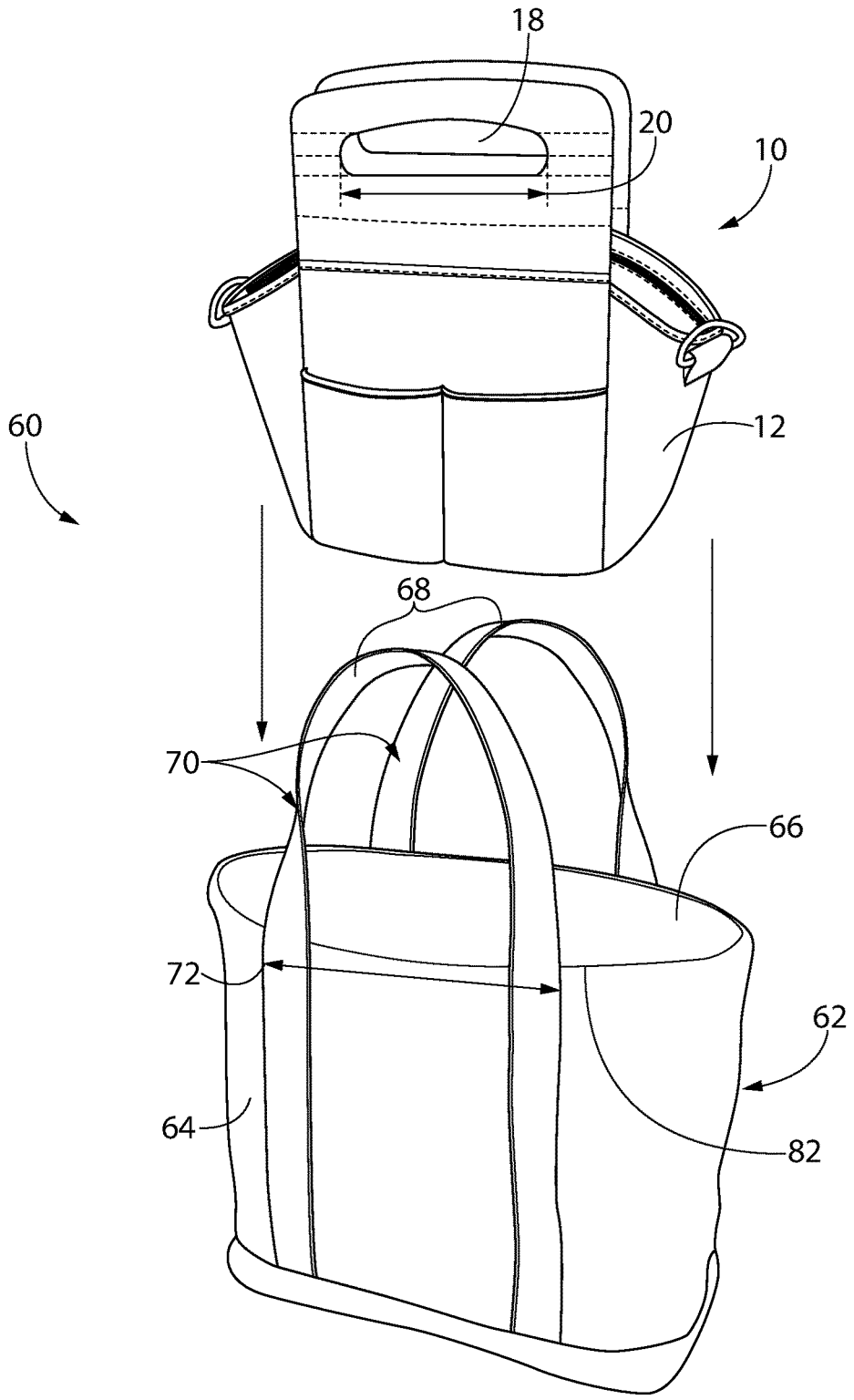
FIG. 7 illustrates a container insert and container according to one embodiment of the present disclosure.
Figure 8:
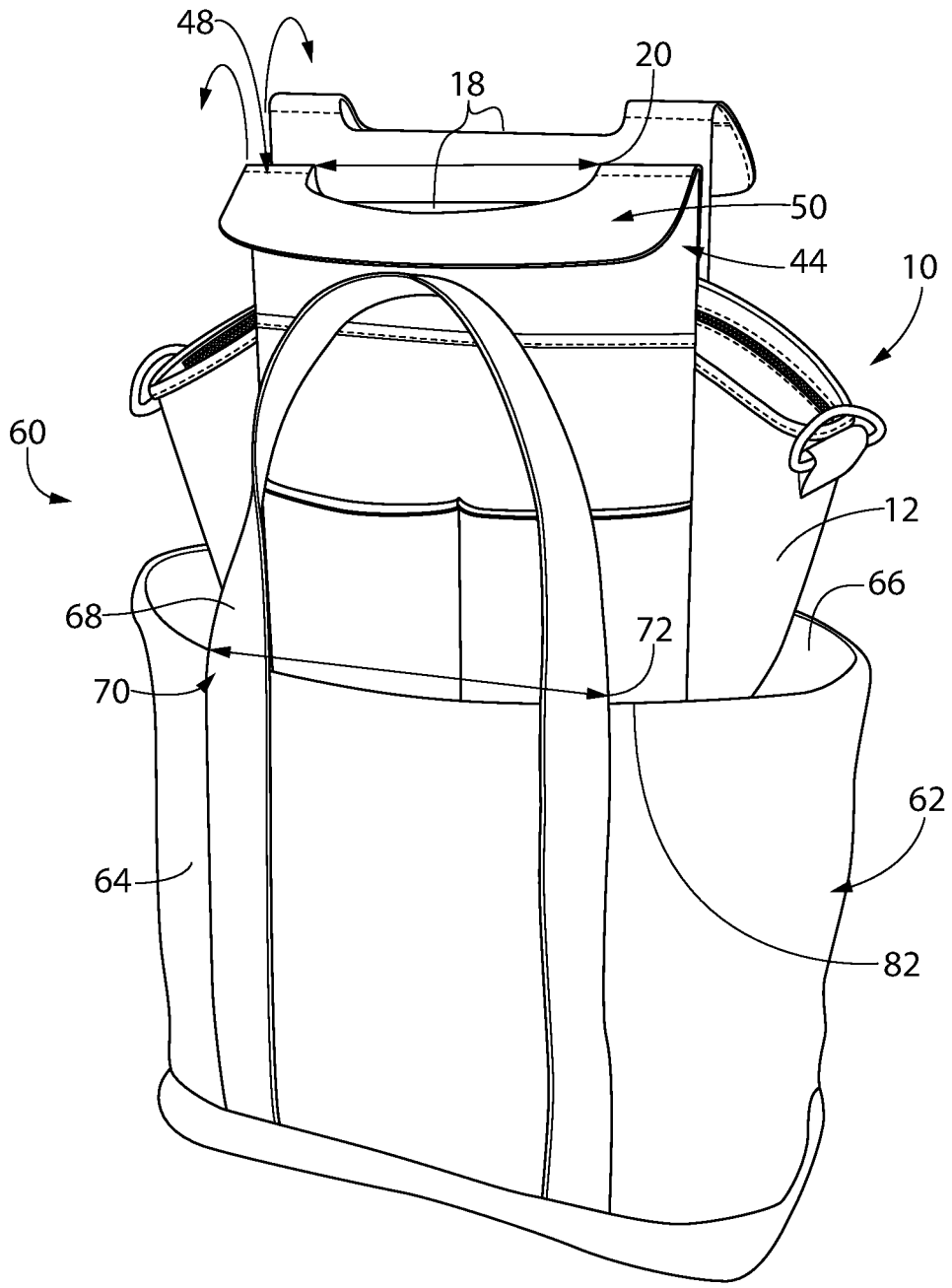
FIG. 8 is a perspective view of a container assembly according to one embodiment of the present disclosure.
Figure 9:
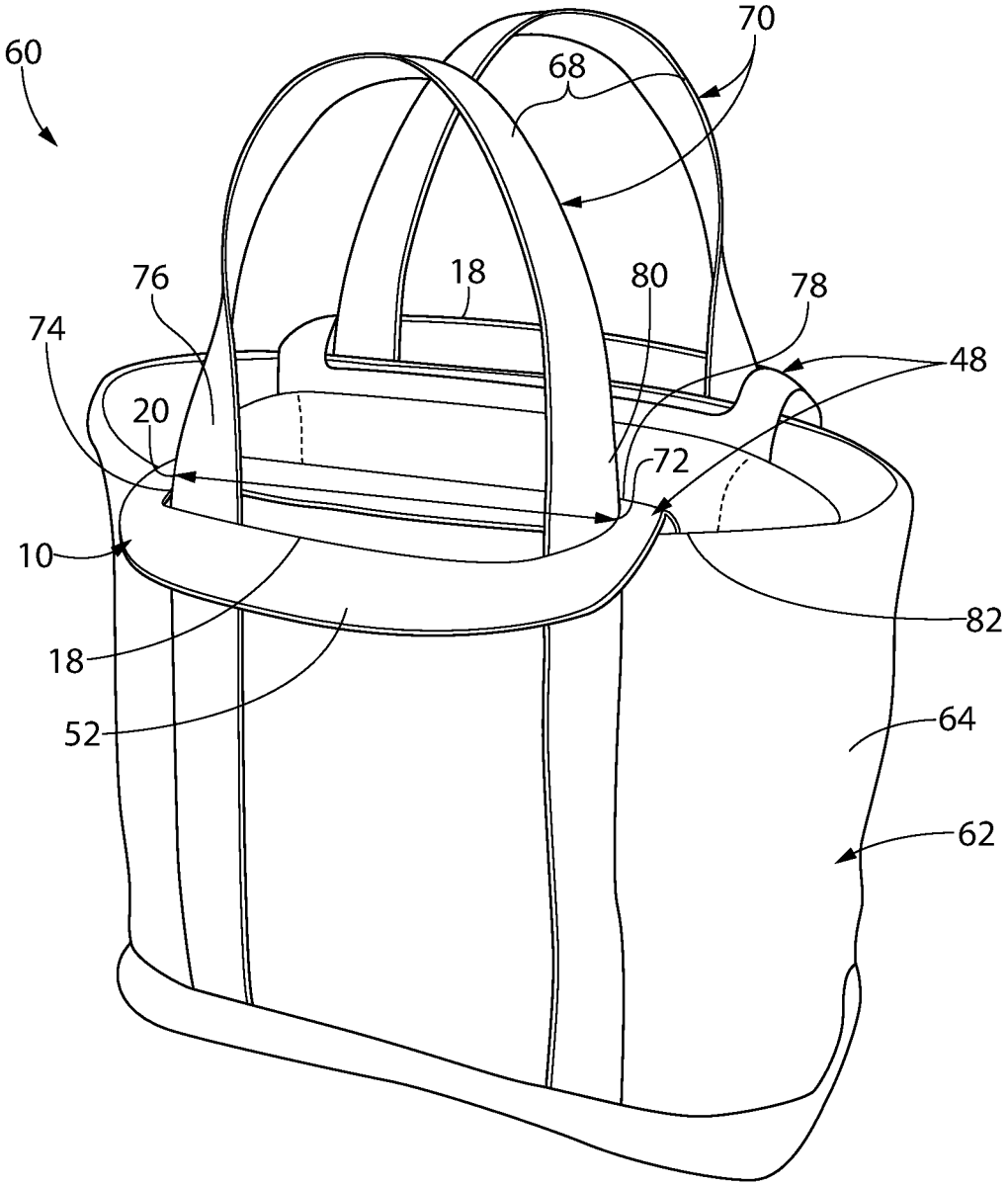
FIG. 9 is a perspective view of a container assembly according to one embodiment of the present disclosure.

Referring now to FIGS. 7-9, one or more embodiments of the present disclosure include a container assembly 60 having a container 62 and the container insert 10. The container 62 of one embodiment is a tote bag. The container 62 of one or more additional embodiments is another type of bag, sack, case, or container. The container 62 includes a main container portion 64 with a container internal volume 66. The main insert portion 12 is sized to be inserted into the container 62. In an embodiment, the container insert 10 is disposed at least partially within the container internal volume 66. The container internal volume 66 and/or one or more dimensions of the container 62 of particular embodiments is substantially equal to the overall size and/or one or more dimensions of the insert 10. The container internal volume 66 and/or one or more dimensions of the container 62 of particular embodiments is greater than the overall size and/or one or more dimensions of the insert 10. The container insert 10 includes at least one external insert dimension, such as an insert overall width or insert overall length in two non-limiting examples, that is substantially equal to an internal container dimension of the container 62, as generally shown in FIGS. 7-9.

The container 62 further includes one or more container handles 68 extending from the main container portion 64 and forming a container handle loop 70 having a container handle loop width 72. The container handle loop width 72 is a distance at the base of the container handle loop 70 or an attachment point of the container handle loop 70 to the main container portion 64 in an embodiment, as illustrated in FIGS. 7-9. In another embodiment, the container handle loop width 72 is defined at a location above the main container portion 64 or base of the container handle loop 70. The container handle loop width 72 of an embodiment is between 6 and 16 inches in an embodiment and between 8 and 12 inches in an embodiment. The container handle loop 72 is less than 6 inches in an embodiment and greater than 16 inches in an embodiment. In a further embodiment, the insert handle opening width 20 of one or more insert handles 14 is substantially equal to the container handle loop width 72. The insert handle opening 18 of one or more insert handles 14 of an embodiment has a first insert handle opening end 74 that is substantially aligned or configured to be substantially aligned with a first container handle end 76 of the container handle 68 and a second insert handle opening end 78 substantially aligned or configured to be substantially aligned with a second container handle end 80 of the container handle 68. One or more of the insert handle openings 18 is sized to accommodate the container handle loop width 72 when the container 62 is held by one or more of the container handles 68.

Figure 2:
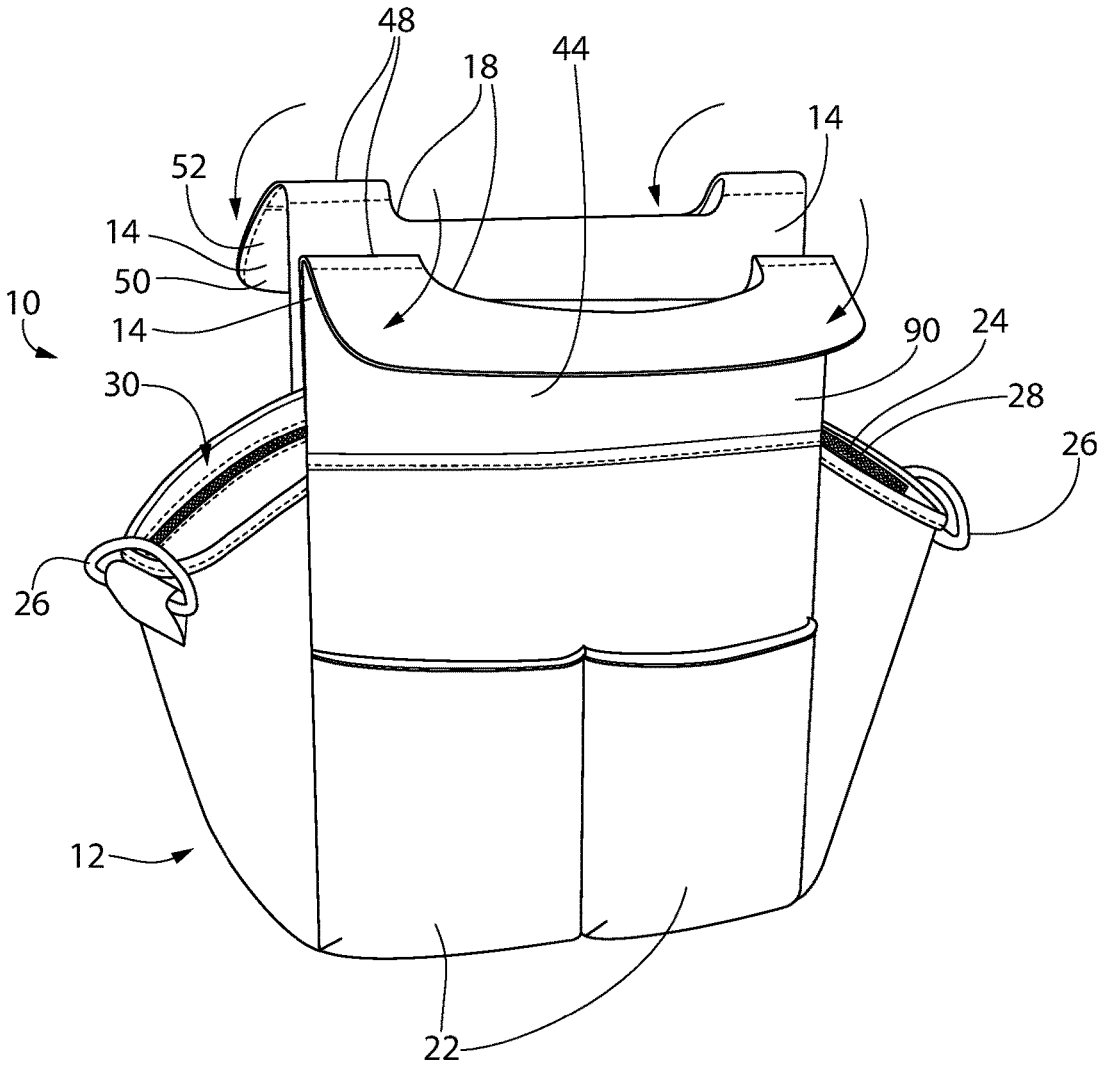
FIG. 2 is a perspective view of a container insert according to one embodiment of the present disclosure.
Figure 3:
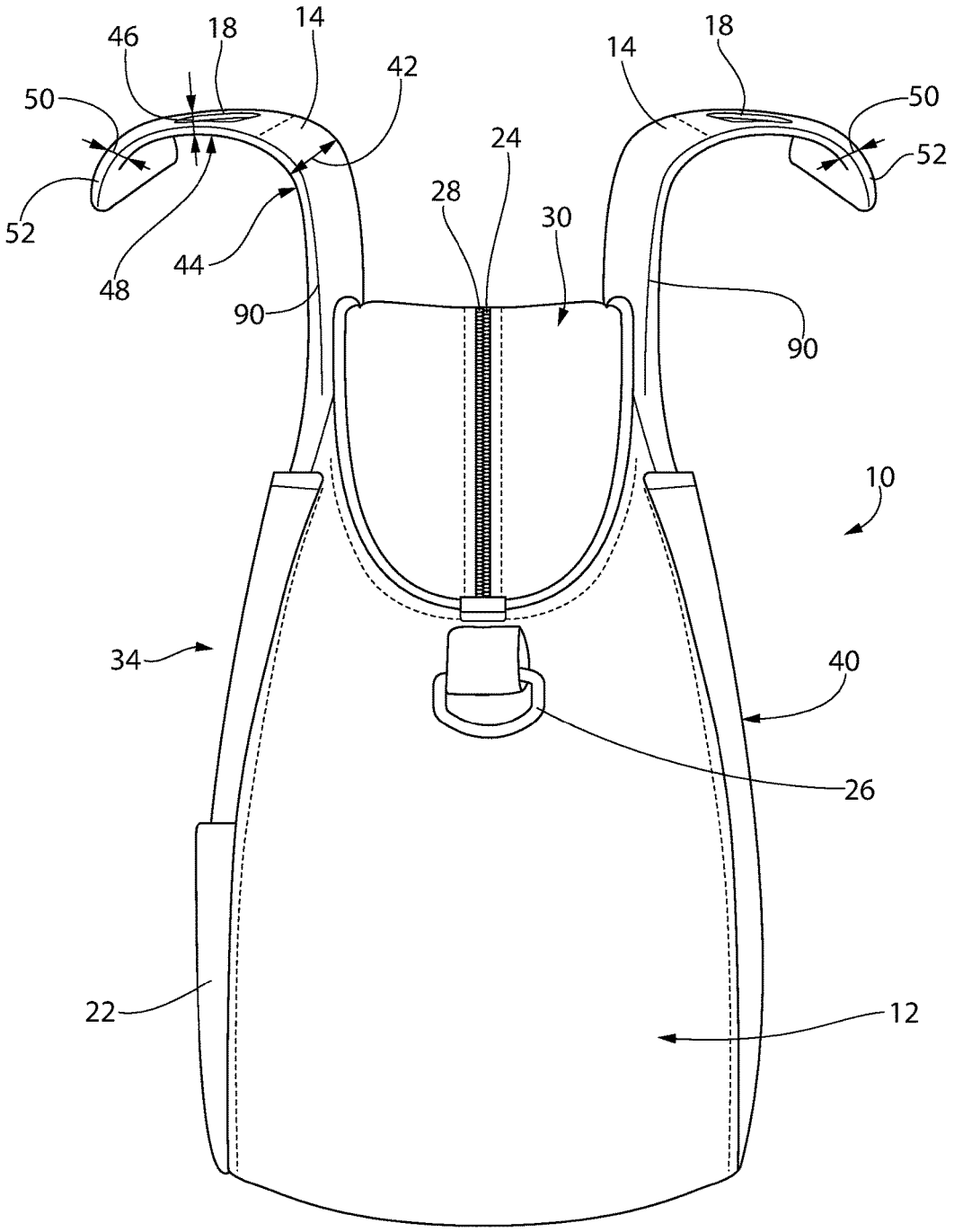
FIG. 3 is a side elevation view of a container insert according to one embodiment of the present disclosure.
Figure 4:
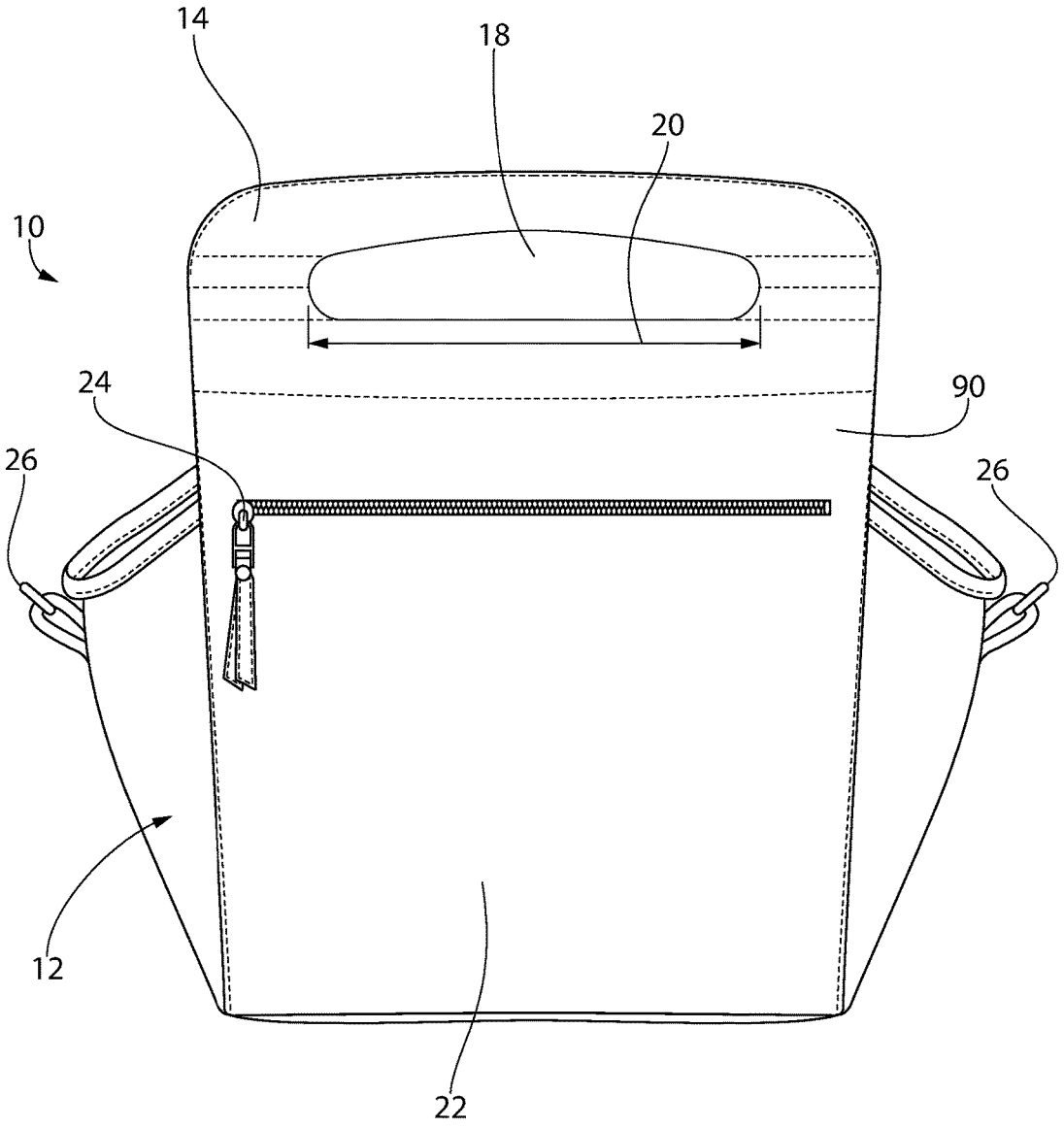
FIG. 4 is a front elevation view of a container insert according to one embodiment of the present disclosure.

Referring specifically to FIGS. 2, 3, 8, and 9, one or more insert handles 14 includes a first thickness 42 at a first location 44 and a second thickness 46 at a second location 48. The first thickness 42 is greater than the second thickness 46 to allow the one or more insert handles 14 to bend at an upper edge 82 of the container 62, as illustrated in FIGS. 7-9. The upper edge 82 of the embodiment illustrated in FIG. 8 is located directly or immediately outside of the one or more container handles 68. In one or more embodiments not shown, the upper edge 82 is spaced from an outer edge of the one or more container handles 68 or is located inside the one or more container handles 68. In an embodiment, the first location 44 is substantially aligned horizontally or laterally with the insert handle opening 18, as illustrated in FIGS. 2 and 3, to allow the insert handle 14 to bend at the insert handle opening 18. In an embodiment, one or more handles 14 includes a third thickness 50 at a third location 52 such that the second location 48 is disposed between the first location 44 and the third location 52. In a further embodiment, the first thickness 42 is substantially equal to the third thickness 50. The one or more insert handles 14 include padding in an embodiment, and padding is not included at the second location 48 to permit the second thickness 46 to be less than the first thickness 42 and/or the third thickness 50. It will be appreciated that other structures and methods may be utilized in the present disclosure to allow the first thickness 42 and/or the third thickness 50 to be greater than the second thickness 46. As illustrated in FIGS. 8 and 9, the ability for the one or more insert handles 14 to bend at the upper edge 82 of the container 62 enhances the integration of the insert 10 with the container 62, improves the aesthetic appearance of the container assembly 60, and allows the container 62 to function as intended while having the insert 10 at least partially disposed therein.

It will be appreciated that the embodiments provided in the present disclosure provide the insert 10 to be positioned at least partially inside of the container 62 to allow one or more items to be container in both the insert 10 and the container 62 without adversely affecting either the items or the container 62. In one non-limiting example, the insert 10 positioned in the container 62, such as a tote bag, forms a diaper bag from the tote bag to permit wet, dirty, or soiled diapers, wipes, clothes, or other items to be handled and transported without the container 62, person carrying the container 62, or anyone or anything near the container 62 being contaminated or otherwise affected by the contents of the insert 10 positioned in the container 62. Similarly, in another non-limiting illustrative example, the insert 10 positioned in the container 62 forms a protective or insulating container to allow fragile items or items that are sensitive to handling, temperature, etc. to be securely handled and transported by the container 62 without other contents within the container 62 but outside the insert 10, a person carrying the container 62, an external temperature or environmental factor, or a manner in which the container 62 is handled affect the sensitive contents of the insert 10 positioned in the container 62. Such non-limiting examples may include the insert 10 having insulating features to allow the insert 10 to essentially serve as a cooler or other temperature-maintaining structure within the container 62, and/or the insert 10 may include one or more rigid structures such that the insert 10 may serve to protect paperwork or other items sensitive to moisture, such as when the container 62 is handled or transported outdoors or through rain or snow, and/or susceptible to folding or bending during handling or transportation. It will be appreciated that the structures and features of the embodiments disclosed herein include additional applications or functions for the insert 10 alone or the container assembly 60 having the insert 10 and the container 62.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. A container insert comprising:

a main insert portion sized to be inserted into a container, the main insert portion having an internal volume; and at least one insert handle extending from the main insert portion, the at least one insert handle having an insert handle opening sized to accommodate a container handle loop width when the container is held by the container handle;

wherein the at least one insert handle includes a first thickness at a first location and a second thickness at a second location, the second location being adjacent to the handle opening, the first thickness being greater than the second thickness to allow the at least one insert handle to bend at an upper edge of the container.

2. The container insert of claim 1, wherein the at least one insert handle includes:

a first insert handle extending from a first side of the main insert portion and having a first insert handle opening sized to accommodate a first container handle loop width; and a second insert handle extending from a second side of the main insert portion and having a second insert handle opening sized to accommodate a second container handle loop width.

3. The container insert of claim 1, wherein the at least one insert handle extends above the main insert portion such that the main insert portion is suspended below the at least one insert handle.

4. The container insert of claim 1, wherein the main insert portion is substantially waterproof.

5. The container insert of claim 1, wherein the main insert portion includes a closure member to substantially seal the internal volume.

6. The container insert of claim 1, wherein the insert handle opening of the at least one insert handle has a first insert handle opening end configured to be substantially aligned with a first container handle end of the container handle and a second insert handle opening end configured to be substantially aligned with a second container handle end of the container handle.

7. A container insert comprising:

a main insert portion sized to be inserted into a container having at least one upper edge, the main insert portion having an internal volume; and at least one insert handle extending from the main insert portion, the at least one insert handle having a first thickness at a first location and a second thickness at a second location, the first thickness being greater than the second thickness to allow the at least one insert handle to bend at the second location around the at least one upper edge of the container;

wherein the at least one insert handle includes an insert handle opening, the second location being substantially aligned with the insert handle opening to allow the at least one insert handle to bend at the insert handle opening.

8. The container insert of claim 7, wherein the at least one insert handle includes a third thickness at a third location, the second location being disposed between the first location and the third location.

9. The container insert of claim 8, wherein the first thickness is substantially equal to the third thickness.

10. The container insert of claim 7, wherein the at least one insert handle extends above the main insert portion such that the main insert portion is suspended below the at least one insert handle.

11. The container insert of claim 7, wherein the at least one insert handle includes:

a first insert handle extending from a first side of the main insert portion and having a first insert handle opening sized to accommodate a first container handle loop width; and a second insert handle extending from a second side of the main insert portion and having a second insert handle opening sized to accommodate a second container handle loop width.

12. The container insert of claim 11, wherein at least one of the first insert handle opening and the second insert handle opening has a first insert handle opening end configured to be substantially aligned with a first container handle end of a container handle and a second insert handle opening end configured to be substantially aligned with a second container handle end of the container handle.

13. The container insert of claim 7, wherein the main insert portion is substantially waterproof.

14. The container insert of claim 7, wherein the main insert portion includes a closure member to substantially seal the internal volume.

15. A container assembly comprising:

a container having a main container portion with a container internal volume;

at least one container handle extending from the main container portion and forming a container handle loop having a container handle loop width;

a container insert disposed at least partially within the container internal volume and having a main insert portion with an insert internal volume; and at least one insert handle extending from the main insert portion and having an insert handle opening width that is substantially equal to the container handle loop width;

wherein the container includes at least one upper edge, the at least one insert handle includes a first thickness at a first location and a second thickness at a second location, the second location substantially aligned with the insert handle opening, and the first thickness is greater than the second thickness such that the at least one insert handle bends at the second location around the upper edge of the container.

16. The container assembly of claim 15, wherein the container insert includes at least one external insert dimension that is substantially equal to an internal container dimension of the container.

17. The container assembly of claim 15, wherein the at least one insert handle includes:

a first insert handle extending from a first side of the main insert portion and having a first insert handle opening sized to accommodate a first container handle loop width; and a second insert handle extending from a second side of the main insert portion and having a second insert handle opening sized to accommodate a second container handle loop width.

* * * * *